United States Patent [19]

Funatani et al.

[11] Patent Number: 4,572,270

[45] Date of Patent: Feb. 25, 1986

[54] METHOD AND APPARATUS FOR MANUFACTURING COMPOSITE MATERIAL USING PRESSURE CHAMBER AND CASTING CHAMBER

[75] Inventors: Kiyoshi Funatani; Tadashi Donomoto; Atsuo Tanaka; Yoshiaki Tatematsu, all of Toyota, Japan

[73] Assignee: Toyota Jidosha Kabushiki Kaisha, Toyota, Japan

[21] Appl. No.: 536,850

[22] Filed: Sep. 29, 1983

[30] Foreign Application Priority Data

Nov. 26, 1982 [JP] Japan ..... 57-207219

[51] Int. Cl.[4] ..... B22D 19/00

[52] U.S. Cl. ..... 164/97; 164/98; 164/103; 164/334; 164/347

[58] Field of Search ..... 164/97–98, 164/100, 103, 105, 108–110, 332–334, 344, 347

[56] References Cited

U.S. PATENT DOCUMENTS 3,668,748 6/1972 Divecha et al. ..... 164/76.1

3,853,635 12/1974 Demendi ..... 164/97

*Primary Examiner*—Nicholas P. Godici

*Assistant Examiner*—Richard K. Seidel

*Attorney, Agent, or Firm*—Oblon, Fisher, Spivak, McClelland & Maier

[57] ABSTRACT

A composite material is manufactured from a formed mass of reinforcing material and matrix metal by introducing the reinforcing material mass into a pressure chamber and holding it there, introducing molten matrix metal into the pressure chamber so as to surround the reinforcing material mass, moving the reinforcing material mass from the pressure chamber into a casting chamber of substantially smaller volume than the pressure chamber while it is still being surrounded by molten matrix metal, and then allowing the molten matrix metal to solidify while applying pressure. If the reinforcing material mass is preheated before being put into the pressure chamber, it can be kept away from the walls of the pressure chamber until after the molten matrix metal has been poured into the pressure chamber and thus will not lose heat to them; and, since the casting chamber can quite tightly conform to the size and shape of the reinforcing material mass, little extra matrix metal needs to be solidified around the reinforcing material mass. Accordingly the resulting composite material can be easily isolated without the need for much post machining.

21 Claims, 8 Drawing Figures

METHOD AND APPARATUS FOR MANUFACTURING COMPOSITE MATERIAL USING PRESSURE CHAMBER AND CASTING CHAMBER

BACKGROUND OF THE INVENTION

The present invention relates to the field of composite reinforced metal type materials, in which a reinforcing material is compounded with matrix metal to form a so called two phase or reinforced material. In such reinforced material, the reinforcing material may be in the form of fibers, threads, whiskers, powder, or the like; and the material of this reinforcing material may be boron, carbon, alumina, silica, silicon carbide, carbon, ceramic, or the like, or mixtures thereof, which have high strength and high elasticity. Further, as matrix metal may be used a metal such as aluminum or magnesium or an alloy thereof.

In motor vehicles and aircraft and so forth, nowadays, the constant demand for lightening and strengthening of structural members and parts has meant that construction from light materials such as aluminum or magnesium has become common. Problems arise, however, in making parts from aluminum or magnesium or their alloys, despite the light weight of these materials, and despite their easy workability, because the mechanical characteristics of such materials such as strength, including bending resistance, torsion resistance, tensile strength, and so on are inferior to those of competing materials such as steel. Further, the occurrence of cracking and the spreading of cracks in parts made of aluminum or magnesium or alloys thereof can be troublesome. Therefore, for parts the strength of which is critical there are limits to the application of aluminum or magnesium or their alloys.

Accordingly, for such critical members, it has become known and practiced for them to be formed out of so called two phase or composite materials, in which reinforcing material is dispersed within a matrix of metal. Thus, if the matrix metal is aluminum or magnesium alloy, then the advantages with regard to weight and workability of using this type of alloy as a constructional material can be obtained to a large degree, while avoiding many of the disadvantages with regard to low strength and crackability; in fact, the structural strength of the composite materials made in this way can be very good, and the presence of the reinforcing material can stop the propagation of cracks through the aluminum or magnesium alloy matrix metal.

Various proposals have been made with regard to compositions for such fiber reinforced metal type composite materials, and with regard to methods of manufacture thereof and apparatuses for performing such manufacture. However, one of the best so far implemented has been the high pressure casting method, a summary of which, as far as its conventional practice is concerned, will now be given.

First a mass of reinforcing material such as reinforcing fibers or the like is placed in the mold cavity of a casting mold, and then a quantity of molten matrix metal is poured into the mold cavity. The free surface of the molten matrix metal is then pressurized to a high pressure such as approximately 1000 kg/cm$^2$ by a plunger or the like, which may be slidingly fitted into the mold. Thereby the molten matrix metal is intimately infiltrated into the interstices of the mass of reinforcing material, under the influence of this pressure. This pressurized state is maintained until the matrix metal has completely solidified. Then finally, after the matrix metal has solidified and cooled into a block, this block is removed from the casting mold, and the surplus matrix metal around the reinforcing material is removed by machining, so that the composite material mass itself, consisting of the mass of reinforcing material impregnated with matrix metal, is isolated. This high pressure casting method has the advantage of low cost, and it is possible thereby to manufacture an element of a relatively complicated shape with high efficiency.

With regard to this high pressure casting method, as is described in Japanese patent application Ser. No. Sho 55-107040 (1980), which is a patent application by the same applicant as the applicant of the parent Japanese patent application Ser. No. Sho 57-207219 of the present patent application of which priority is being claimed in the present application, the reinforcing material mass may be preheated to a substantially high temperature of at least the melting point of the matrix metal, before the matrix metal is poured into the mold cavity of the casting mold, in order to aid with the proper penetration into and proper impregnation of the reinforcing material by the matrix metal. This preheating ensures that as the molten matrix metal infiltrates into the interstices of the reinforcing material, it is not undesirably cooled down by the reinforcing material being cold, so as to at least partly solidify. Such solidification, if it occurs, much deteriorates the impregnation of the reinforcing material by the matrix metal, and accordingly this type of preheating is very beneficial. More details will be found in the above identified Japanese patent application or laying open publication, if required.

Further, as is described in Japanese patent application Ser. No. Sho 56-32289 (1981), which is also a patent application by the same applicant as the applicant of the parent Japanese patent application Ser. No. Sho 57-207219 of the present patent application, the reinforcing material mass may be, before the casting process, charged into a case (which may be made of stainless steel or the like) of which only one end is left open, an air chamber being left between the reinforcing material mass and the closed end of the case, and then the case with the reinforcing material mass therein may be placed into the mold cavity of the casting mold, and pressure casting as described above may be carried out. This concept of utilizing a case with an air chamber being left therein again serves to aid with the proper penetration into and proper impregnation of the reinforcing material by the matrix metal, because the air left in the air chamber, when the matrix metal is pressurized at the outside of the case, will be compressed to almost nothing as the matrix metal in the molten state flows through the interstices of the reinforcing material in a directed fashion towards the air chamber, and thereby the proper penetration of the matrix metal into the interstices of the reinforcing materials is very much helped. More details will be found in the above identified Japanese patent application or laying open publication, if required.

Now, with regard to the per se conventional preheating discussed above, in this high pressure casting method, this is conventionally done by heating up the reinforcing material, which typically has been formed into a shaped mass, to said substantially high temperature at least equal to the melting point of the matrix metal, and then by rapidly putting the reinforcing material into the mold cavity of the casting mold and immediately rapidly pouring the molten matrix metal into said mold cavity around the reinforcing material, shortly subsequently applying pressure to infiltrate said molten matrix metal into the reinforcing material. However, when this is done, the following difficulties arise.

First, if the reinforcing material shaped mass is much smaller in size than the mold cavity of the casting mold, in which case said shaped mass may be supported within the mold cavity upon supports as suggested in the previously identified Japanese patent application, then the advantage is obtained that no substantial loss of heat occurs from the thus preheated reinforcing material to the sides of the mold cavity, before the matrix metal in the molten state has been completely poured into said mold cavity. On the other hand, the disadvantage is caused that the finished composite material mass produced consists of a mass of reinforcing material infiltrated with matrix metal with a relatively thick layer of solidified pure matrix metal around it. Now, this is often very inconvenient for post processing of the composite material, since stripping off of such a thick layer of matrix metal from the outside of the finished produced metallic block part of which is composite reinforced by the included reinforcing material is substantially troublesome, and since in many applications a piece of material is required which is substantially completely composed of reinforced material, i.e. is without any parts made only of matrix metal.

But if instead the reinforcing material shaped mass is almost equal in size to the mold cavity of the casting mold, then the disadvantage is caused that substantial loss of heat occurs from the thus preheated reinforcing material to the sides of the mold cavity, before the matrix metal in the molten state has been completely poured into said mold cavity, which can seriously deteriorate the infiltration of the molten matrix metal into the interstices of the reinforcing material and the quality of the resulting composite material; although on the other hand the advantage is obtained that the finished composite material mass produced consists of a mass of reinforcing material infiltrated with matrix metal with a relatively thin layer of solidified pure matrix metal around it, which as explained above is often very convenient for post processing of the composite material. In fact, it has in the prior art appeared quite difficult to resolve this conflict.

Further, when the reinforcing material mass is, before the casting process, charged into a case of which only one end is left open, an air chamber being left between the reinforcing material mass and the closed end of the case, and the high pressure casting process is carried out with the reinforcing material remaining in this case, as outlined above and as described in the previously identified Japanese patent application at length, then, although the proper penetration into and proper impregnation of the reinforcing material by the matrix metal is thereby greatly aided, the problems described above with regard to isolating the finished composite material, which of course involved stripping off of the case from the outside of the finished composite reinforced material, are intensified. In the event that the case is made of stainless steel, which is a suitable material therefor, the difficulty of removing the finished composite material from the case is so high as to be unacceptable in practice. This has, in the prior art, made it difficult to take advantage of the above described prior art concept of including the reinforcing material in a case while forming the composite material.

SUMMARY OF THE INVENTION

Accordingly, it is the primary object of the present invention to provide a method for manufacturing a composite material, which avoids the above described problems.

It is a further object of the present invention to provide a method for manufacturing a composite material, which allows the advantages of the practice of preheating the reinforcing material to a temperature at least as high as the melting point of the matrix metal to be satisfactorily realized.

It is a further object of the present invention to provide a method for manufacturing a composite material, which avoids the occurrence of the problem that the reinforcing material, after having been preheated, should become too much cooled down in the mold cavity of the casting mold, before the molten matrix metal is poured thereinto.

It is a further object of the present invention to provide a method for manufacturing a composite material, which well infiltrates the molten matrix metal into the interstices of the reinforcing material.

It is a further object of the present invention to provide a method for manufacturing a composite material, which achieves the advantages of the previously described use of a case with only one end open for containing the reinforcing material during the high pressure casting process, without attendant disadvantages.

It is a further object of the present invention to provide a method for manufacturing a composite material, which infiltrates the molten matrix metal into the interstices of the reinforcing material in a directed manner.

It is a yet further object of the present invention to provide a method for manufacturing a composite material, which effectively produces a composite material mass without any requirement for extensive post machining thereof.

It is a yet further object of the present invention to provide a method for manufacturing a composite material, which effectively produces a composite material mass without any substantial extraneous material being left therearound.

It is a yet further object of the present invention to provide a method for manufacturing a composite material, which effectively produces a composite material mass without any thick layer of surrounding solidified pure matrix metal.

It is a yet further object of the present invention to provide a method for manufacturing a composite material, which effectively produces a composite material mass without any surrounding case being left therearound.

It is a yet further object of the present invention to provide a method for manufacturing a composite material, which produces composite material at low cost.

It is a yet further object of the present invention to provide a method for manufacturing a composite material, which produces composite material in an efficient manner.

It is a yet further object of the present invention to provide a method for manufacturing a composite material, which produces composite material which has good mechanical characteristics.

It is a yet further object of the present invention to provide a method for manufacturing a composite material, which produces composite material which has good and even compounding between the matrix metal and the reinforcing material thereof.

It is a yet further object of the present invention to provide an apparatus for manufacturing a composite material, by practicing such a method as will satisfy the above objects.

It is a yet further object of the present invention to provide a method for effectively operating such an apparatus for manufacturing a composite material.

According to the most general method aspect of the present invention, these and other objects relating to a method are accomplished by a method of manufacturing a composite material from a formed mass of reinforcing material and matrix metal, wherein in order: (a) said formed mass of reinforcing material is introduced into a pressure chamber and is held therein; (b) molten matrix metal is introduced into said pressure chamber so as to surround said formed mass of reinforcing material being held therein; (c) said formed mass of reinforcing material, while still being surrounded in said pressure chamber by said molten matrix metal, is moved from said pressure chamber into a casting chamber of substantially smaller volume than said pressure chamber; and (d) while pressure is being applied, said molten matrix metal is allowed to solidify.

According to such a method, it is possible to heat the formed mass of reinforcing material up, as for example to a temperature at least equal to the melting point of the matrix metal, before placing it to be held in the pressure chamber; and, since the pressure chamber is substantially larger than the reinforcing material mass (which can fit into the casting chamber), said reinforcing material mass need not come to be very near the walls of said pressure chamber. Thereby, it will not occur that the reinforcing material, after having been thus preheated, should become too much cooled down in the pressure chamber, before the molten matrix metal is poured thereinto. Thus, the advantages of the practice of preheating the reinforcing material to a temperature at least as high as the melting point of the matrix metal may be satisfactorily realized, and by this preheating the molten matrix metal is well infiltrated into the interstices of the reinforcing material. Therefore, the resulting composite material has good mechanical characteristics, and good and even compounding are obtained between the matrix metal and the reinforcing material thereof. Further, because the casting chamber into which the reinforcing material mass is moved when once it is surrounded by molten matrix metal and the problem of cooling thereof has passed, and within which the matrix metal solidifies within and around the reinforcing material mass, is substantially smaller than the pressure chamber, and may in fact quite closely conform to the size and shape of said reinforcing material mass, the amount of post machining of the composite material mass produced by this method is reduced as compared with the case of a conventional process, since less extraneous matrix metal is left around the composite material. Thereby composite material can be produced at low cost and in an efficient manner.

Further, according to a more particular method aspect of the present invention, these and other objects relating to a method are more particularly and concretely accomplished by such a method of manufacturing a composite material as described above, wherein before step (a) said formed mass of reinforcing material is preheated to at least the melting point of said matrix metal, and/or by such a method of manufacturing a composite material as described above, wherein during steps (a) and (b) said formed mass of reinforcing material does not substantially approach the sides of said pressure chamber.

According to such a method, the heat imparted to said formed mass of reinforcing material by such preheating is definitely not substantially lost to the sides of said pressure chamber, before said molten matrix metal is poured into said pressure chamber.

Further, according to another more particular method aspect of the present invention, these and other objects relating to a method are more particularly and concretely accomplished by such a method of manufacturing a composite material as described above, wherein said formed mass of reinforcing material, after being moved into said casting chamber, fits closely inside said casting chamber.

According to such a method, very little if any matrix metal will solidify as a layer around the mass of composite material that is formed by the solidification of the molten matrix metal within the interstices of the reinforcing material mass. Thereby, the advantages of the present invention with regard to economy and convenience of manufacture of the resulting composite material are best realized. In the best case, it will be possible to isolate the composite material produced, merely by a single cut which separates the mass of matrix metal solidified within the pressure chamber from the mass of composite material solidified within the casting chamber.

Further, according to another more particular method aspect of the present invention, these and other objects relating to a method are more particularly and concretely accomplished by such a method of manufacturing a composite material as first described above, wherein said moving of said formed mass of reinforcing material from said pressure chamber into said casting chamber is performed mechanically; or alternatively by such a method of manufacturing a composite material as first described above, wherein said moving of said formed mass of reinforcing material from said pressure chamber into said casting chamber is performed by the force of said pressure applied upon said molten matrix metal in said pressure chamber, which has the advantage of simplicity.

Yet further, according to another more particular method aspect of the present invention, these and other objects relating to a method are more particularly and concretely accomplished by such a method of manufacturing a composite material as first described above, wherein said casting chamber is initially present and is substantially empty, before said molten matrix metal is introduced into said pressure chamber so as to surround said formed mass of reinforcing material being held therein, and wherein further, before said molten matrix metal is introduced into said pressure chamber so as to surround said formed mass of reinforcing material being held therein, said formed mass of reinforcing material substantially intercepts communication between said pressure chamber and said casting chamber.

According to such a method, the effect of the previously identified Japanese patent application Ser. No. Sho 56-32289 may be obtained, since the pressurized matrix metal will tend to percolate through the interstices of the reinforcing material, which is intercepting communication between said pressure chamber and said casting chamber, under the influence of the difference in pressure between these two chambers. Thereby, the advantages of using a case with one end only open, and an air chamber defined therein, as described previously, are attained, and the molten matrix metal is infiltrated into the interstices of the reinforcing material in a directed manner. This is done without the need arising for the removal of any case such as was used in the above identified prior art from around the composite material, after solidification of the matrix metal, which is accordingly very advantageous.

In this case, it may be that said moving of said formed mass of reinforcing material from said pressure chamber into said casting chamber is performed by the force of said pressure applied upon said molten matrix metal in said pressure chamber which is not balanced by a comparable pressure in said casting chamber, which is very convenient and easy.

On the other hand, according to an alternative particular method aspect of the present invention, these and other objects relating to a method are more particularly and concretely accomplished by such a method of manufacturing a composite material as described above, wherein said casting chamber is not initially present before said molten matrix metal is introduced into said pressure chamber so as to surround said formed mass of reinforcing material being held therein, but is opened up by the retreat of a member defining a part of the surface of said pressure chamber, as said formed mass of reinforcing material is moved from said pressure chamber into said casting chamber; and in this case it may be that said formed mass of reinforcing material is moved from said pressure chamber into said casting chamber, as said casting chamber opens up, by being attached to said member defining a part of the surface of said pressure chamber and being pulled thereby as it retreats. This member may in fact be a knock pin which is later used to expel the solidifed mass from the apparatus.

According to the most general apparatus aspect of the present invention, these and other objects relating to an apparatus are accomplished by an apparatus for manufacturing a composite material from a formed mass of reinforcing material and matrix metal, comprising: (a) a pressure chamber; (b) a casting chamber of substantially smaller volume than said pressure chamber; (c) a means for applying pressure to molten matrix metal in said pressure chamber; and (d) a means for holding said formed mass of reinforcing material in said pressure chamber while molten matrix metal is introduced into said pressure chamber.

According to such an apparatus, the formed mass of reinforcing material may be heated up for example to a temperature at least equal to the melting point of the matrix metal, before it is placed and held by the means for doing so in the pressure chamber, and, since the pressure chamber is substantially larger than the reinforcing material mass which can fit into the casting chamber, said reinforcing material mass need not come to be very near the walls of said pressure chamber, and thus it need not occur that the reinforcing material after having been thus preheated should become too much cooled down in the pressure chamber, during the inevitable delay period before the molten matrix metal is poured thereinto. Thus, the full advantage of the practice of preheating the reinforcing material to a temperature at least as high as the melting point of the matrix metal may be satisfactorily realized, and by the performance of this preheating the molten matrix metal is well infiltrated into the interstices of the reinforcing material. Therefore, the resulting composite material as produced by this apparatus has good mechanical characteristics, and good and even compounding are ensured to be obtained between the matrix metal and the reinforcing material thereof. Further, because the casting chamber, into which the reinforcing material mass is moved, when once it is surrounded by molten matrix metal and the problem of cooling thereof has passed, and within which the matrix metal solidifies within and around the reinforcing material mass, is substantially smaller than the pressure chamber, and may in fact quite closely conform to the size and shape of said reinforcing material mass, the amount of post machining of the composite material mass produced by this method is reduced as compared with the case of a conventional process, since less extraneous matrix metal is left around the composite material mass. Thereby composite material can be produced at low cost and in an efficient manner.

Further, according to a more particular apparatus aspect of the present invention, these and other objects relating to an apparatus are more particularly and concretely accomplished by such an apparatus for manufacturing a composite material as described above, further comprising a means for moving said formed mass of reinforcing material from said pressure chamber into said casting chamber while said formed mass is surrounded by molten matrix metal in said pressure chamber.

According to such an apparatus, this means positively and definitely moves said formed mass of reinforcing material from said pressure chamber into said casting chamber. Now, the casting chamber may be substantially always present; or alternatively the casting chamber may not always be present, but may be selectively opened up by the retreat of a member defining a part of the surface of said pressure chamber, which may be a knock out pin. In such a case, the means for moving said formed mass of reinforcing material from said pressure chamber into said casting chamber may be a part of this defining member which is adapted to pullingly receive a part of said formed mass of reinforcing material.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENTS

The present invention will now be described with reference to several preferred embodiments of the method and the apparatus thereof, and with reference to the appended drawings.

THE FIRST PREFERRED EMBODIMENT

Figure 1:
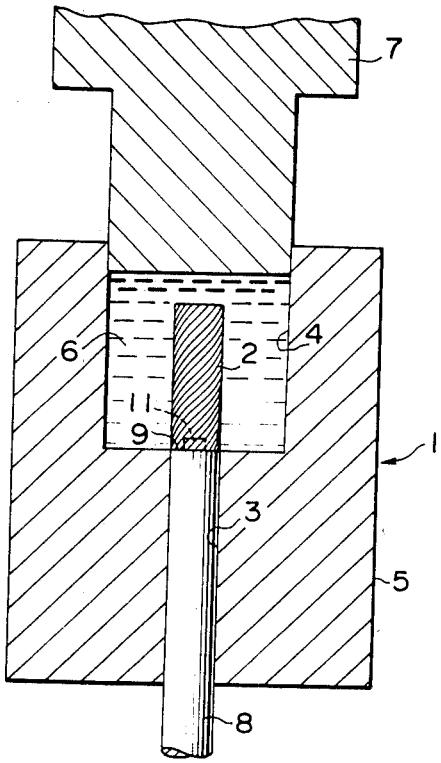
FIG. 1 is an explanatory longitudinal sectional view of a first preferred embodiment of the apparatus for producing composite material according to the present invention, shown in an earlier stage of practicing a first preferred embodiment of the method for manufacturing composite material according to the present invention in which a tubular reinforcing material mass is located within an upper pressure chamber thereof and is held therein by an opening in said reinforcing material mass, said first preferred apparatus embodiment providing a lower casting chamber below said upper pressure chamber thereof.
Figure 2:
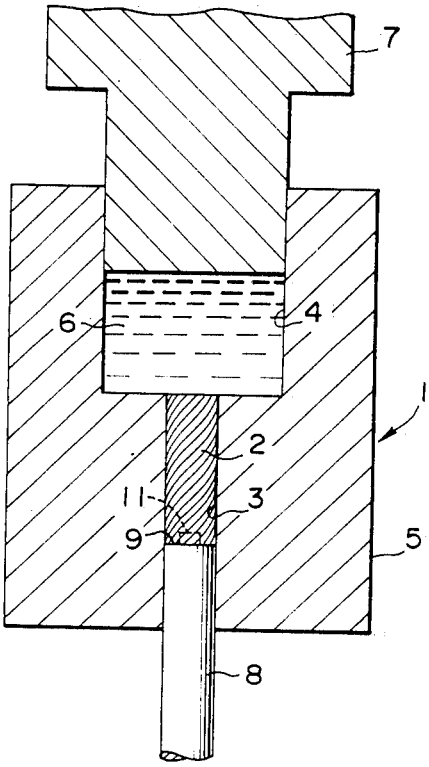
FIG. 2 is an explanatory longitudinal sectional view, similar to FIG. 1, of said first preferred embodiment of the apparatus according to the present invention, shown in an later stage of practicing said first preferred embodiment of the method according to the present invention, in which said reinforcing material mass is located within said lower casting chamber thereof.

FIG. 1 and FIG. 2 are explanatory longitudinal sectional views of an apparatus or casting device 1 which is a first preferred embodiment of the apparatus for manufacturing composite material of the present invention, shown in two different phases of performance of manufacture of composite material according to a first preferred embodiment of the method for manufacturing composite material according to the present invention. In these figures, the reference numeral 2 denotes a formed body of reinforcing material, shown in perspective view in detail in FIG. 3, which is being incorporated into the composite material.

First to describe the structure of the casting device 1: as shown in FIGS. 1 and 2, it incorporates a casting mold 5, within which, in this first preferred embodiment of the apparatus according to the present invention, there are defined two chambers: an upper or pressure chamber 4 which is shaped as a cylinder of a relatively large diameter, and a lower or casting chamber 3 the side surface of which is formed as a cylinder of a relatively small diameter (in fact of approximately the diameter of the formed body 2 of reinforcing material that is anticipated to be used with this apparatus for being incorporated into composite material, i.e. in this first preferred embodiment of diameter about 25 mm), which is coaxial with the upper pressure chamber 4 and axially communicated thereto, opening from its bottom. In this first preferred apparatus embodiment, the casting chamber 3 is open at its bottom, extending through the bottom portion of the casting mold 5 and thus being formed as a cylindrical through hole. A cylindrical pressure plunger 7 is adapted to be slidingly inserted into the cylindrical upper or pressure chamber 4 from the top downwards and slides tightly therein in a gas tight manner; and a cylindrical knock out pin 8 is adapted to be slidingly inserted into the cylindrical lower or casting chamber 3 from the bottom upwards and also slides tightly therein in a gas tight manner. In this particular first preferred apparatus embodiment, the top end surface 9 of this knock out pin 8 is formed with a central protuberance 11 for a purpose which will become apparent later, with a diameter which in this first preferred embodiment was about 10 mm.

This casting device 1 was used as follows, in order to practice the first preferred embodiment of the method for manufacturing composite material according to the present invention.

Figure 3:
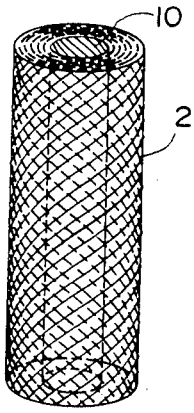
FIG. 3 is a detailed perspective view of said formed body or mass of reinforcing material, which is being incorporated into the composite material which is being manufactured by the method which is shown as being practiced in FIGS. 1 and 2, according to said first preferred embodiment of the present invention.

First, a hollow cylindrical reinforcing material formed body 2 was formed as shown in FIG. 3 of carbon fibers of type "Toreka M-40", of average fiber diameter 7 microns, manufactured by Tore K. K. This reinforcing material formed body 2 had a central axial hole 10, and its approximate dimensions were: length 80 mm, internal diameter 10 mm, and external diameter 24 mm. The formed body 2 was manufactured by winding the carbon fibers at a 25° angle.

Next, after performing a per se well known surface treatment on this formed body 2, it was heated to a temperature of 700° C. in argon gas, as a form of preheating of the type discussed above in the part of this specification entitled "BACKGROUND OF THE INVENTION". Then, with the plunger 7 withdrawn from the casting device 1 of FIGS. 1 and 2 so that the top opening of the pressure chamber 4 of the casting mold 5 thereof was open, and with the knock out pin 8 in the position in the casting chamber 3 thereof as shown in FIG. 1 with the periphery of its top 9 end flush with the bottom surface of the pressure chamber 4, the reinforcing material formed body 2 was moved into this pressure chamber 4, and one of its ends was fitted over the protuberance 11, which fitted snugly and tightly into the hole 10 of said formed body 2, so as to hold the thus preheated reinforcing material formed body 2 securely within said pressure chamber 4 without the sides of said formed body 2 coming near the sides of said pressure chamber 4. Thereby, the formed body 2 of reinforcing material was effectively kept from being cooled by the casting mold 5, by being kept clear of the sides of the mold, without the use of any particular support structure therefor.

Immediately after this insertion of the reinforcing material formed body 2 into the pressure chamber 4, while said formed body 2 was still in the preheated condition, a quantity 6 of molten matrix metal, which in this first preferred embodiment of the present invention was aluminum alloy of JIS standard AC4C at about 750° C., was poured into the pressure chamber 4 so as to surround the formed body 2 therein, and then the plunger 7 was slidingly inserted into the top of the pressure chamber 4 from above, so as to press on the free surface of the molten aluminum alloy mass 6. This is the state of the apparatus as shown in FIG. 1.

From this state, while still the aluminum alloy matrix metal mass 6 was completely molten, the plunger 7 was progressively pressed downwards so as to increase the pressure on the molten aluminum alloy mass 6 in the pressure chamber 4. Thus the molten aluminum alloy mass 6 started to be forced by this increasing pressure into the interstices of the reinforcing material formed mass 2, so as to become intimately intermingled with the carbon fibers thereof.

When the pressure in the pressure chamber 4 reached about 200 kg/cm$^2$, then the knock out pin 8 was lowered by an external positioning means, not shown, from its position as seen in FIG. 1 to its lower position as seen in FIG. 2, in which its upper end 9 was about 80 mm below the bottom surface of the pressure chamber 4. Thus, the lower or casting chamber 3 was opened out to be about 80 mm long, i.e. to be substantially of the dimensions of the reinforcing material formed body 2, both radially and axially. At this time, because the projection 11 in the middle of this upper end 9 of the knock out pin 8 was securely engaged in the hole 10 of the reinforcing material formed body 2, therefore the formed body 2 was carried downwards into the casting chamber 3 on the end of the knock out pin 8, so as substantially to fill it, along with the molten aluminum alloy matrix metal which was already somewhat entrained into its interstices; and the upper end of said reinforcing material formed body 2 came to be substantially flush with the bottom surface of the pressure chamber 4.

Next, the pressure provided in the pressure chamber 4 by the force applied to the plunger 7 was gradually increased, according to the force applied to the top end of the plunger 7 by a means not shown in the figures and not further discussed herein, until it reached a value of approximately 1500 kg/cm$^2$. This pressurized state was maintained while the aluminum alloy matrix metal mass 6 cooled, until it had completely solidified.

Then the plunger 7 was removed from the top of the apparatus, and the solidified cast form produced was removed from the apparatus by the knock out pin 8 being pushed upwards in the figures. This cast form in fact consisted, as will be easily understood based upon the foregoing descriptions, of a larger cylinder made of solidified aluminum alloy only, which had been formed by solidification of aluminum alloy in the pressure chamber 4, and a smaller cylinder coaxially abutted thereto made substantially completely of reinforcing carbon fiber material infiltrated with aluminum alloy matrix metal to form a composite material cylinder, which had been formed by solidification of aluminum alloy in the interstices of the carbon fiber reinforcing material shaped body 2 in the casting chamber 3.

Finally, this smaller composite material cylinder was cut away from the larger aluminum alloy cylinder abutted thereto. This separation was accomplished by a single simple saw cut, which is a very important feature of the present invention. The larger aluminum alloy cylinder was of course recycled, while the composite material cylinder, which was the finished product, was cut in cross section and examined under an electron microscope. The results of this observation were that no casting flaws at all were observed, such as for example penetration faults where the aluminum alloy matrix metal might not have penetrated into the carbon fiber reinforcing material body sufficiently, even at the surface of the composite material body. Thus, it was confirmed that the aluminum alloy matrix metal had satisfactorily and evenly penetrated into the reinforcing material formed body, between the carbon fibers of which it was composed, across the entire cross section of the composite material.

Thus it will be seen that, according to this first preferred embodiment of the present invention, it is possible to heat the formed mass 2 of reinforcing material up to a temperature at least equal to the melting point of the matrix metal, before placing it to be held in the pressure chamber 4; and, since the pressure chamber 4 is substantially larger than the reinforcing material mass 2, said reinforcing material mass 2 need not come to be very near the walls of said pressure chamber 4. Thereby, it will not occur that the reinforcing material mass 2, after having been thus preheated, should become too much cooled down in the pressure chamber 4, before the molten matrix metal 6 is poured thereinto. Thus, the advantages of the practice of preheating the reinforcing material to a temperature at least as high as the melting point of the matrix metal as described in the portion of this specification entitled "BACKGROUND OF THE INVENTION" may be satisfactorily realized, and by this preheating the molten matrix metal is well infiltrated into the interstices of the reinforcing material. Therefore, the resulting composite material mass has good mechanical characteristics, and good and even compounding are obtained between the matrix metal and the reinforcing material thereof. Further, the casting chamber 3, into which the reinforcing material mass 2 is moved when once it is surrounded by molten matrix metal and the problem of cooling thereof has passed, and within which the matrix metal 6 solidifies within and around the reinforcing material mass 2, is substantially smaller than the pressure chamber 4, and in fact quite closely conforms to the size and shape of said reinforcing material mass 2. Thus the amount of post machining of the composite material mass produced by this method is reduced as compared with the case of a conventional process, since almost no extraneous matrix metal is left around the composite material. Thereby composite material can be produced at low cost and in an efficient manner.

THE SECOND PREFERRED EMBODIMENT

Figure 4:
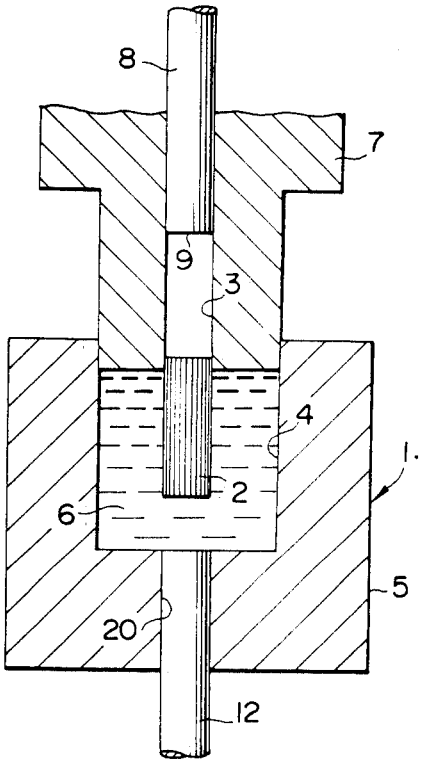
FIG. 4 is an explanatory longitudinal sectional view, similar to FIG. 1, of a second preferred embodiment of the apparatus for producing composite material according to the present invention, shown in an earlier stage of practicing a second preferred embodiment of the method for manufacturing composite material according to the present invention in which a tubular reinforcing material mass is located within a lower pressure chamber thereof and is held therein by an opening in said reinforcing material mass, said second preferred apparatus embodiment providing an upper casting chamber above said lower pressure chamber thereof, within a pressure plunger.
Figure 5:
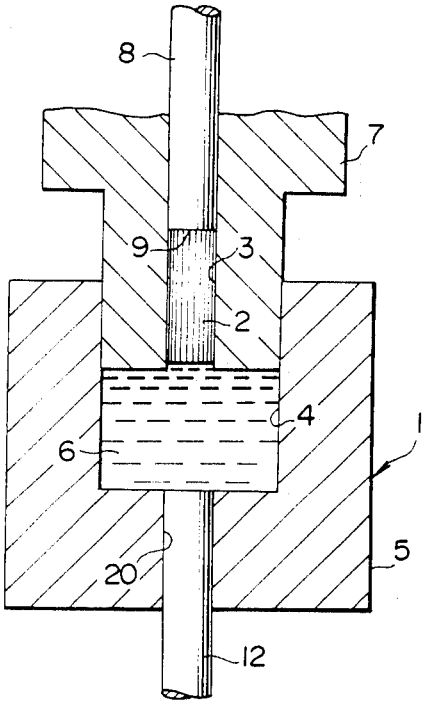
FIG. 5 is an explanatory longitudinal sectional view, similar to FIG. 2, of said second preferred embodiment of the apparatus according to the present invention, shown in an later stage of practicing said second preferred embodiment of the method according to the present invention, in which said reinforcing material mass is located within said upper casting chamber thereof.

FIGS. 4 and 5 show, in a fashion similar to FIGS. 1 and 2 respectively, in explanatory longitudinal sectional views, an apparatus or casting device 1 which is a second preferred embodiment of the apparatus for manufacturing composite material of the present invention, again in two different phases of performance of manufacture of composite material according to a second preferred embodiment of the method for manufacturing composite material according to the present invention. In these figures, parts of the second preferred apparatus embodiment shown, which correspond to parts of the first preferred apparatus embodiment shown in FIGS. 1 and 2, and which have the same functions, are designated by the same reference numerals as in those figures. In this second preferred embodiment, the form of the reinforced material shaped mass 2 is the same as that in the first preferred embodiment, as illustrafted in FIG. 3.

First to describe the structure of the casting device 1: as shown in FIGS. 4 and 5, it incorporates a casting mold 5, within which, in this second preferred embodiment of the apparatus according to the present invention, there is only defined one chamber, a lower or pressure chamber 4 which is shaped as a cylinder of a relatively large diameter. In this second preferred apparatus embodiment, the lower pressure chamber 4 is formed with a through hole 20 extending through the bottom portion of the casting mold 5, and thus is open at its bottom. A cylindrical second knock out pin 12 is adapted to be slidingly inserted into the through hole 20 from the bottom upwards and slides tightly therein in a gas tight manner, thus closing the lower pressure chamber 4. A cylindrical pressure plunger 7 is adapted to be slidingly inserted into the cylindrical lower or pressure chamber 4 from the top downwards and slides tightly therein in a gas tight manner; and an upper or casting chamber 3 is defined in the interior of said cylindrical pressure plunger 7, its side surface being formed as a cylindrical through hole of a relatively small diameter (in fact again of approximately the diameter of the formed body 2 of reinforcing material that is anticipated to be used with this apparatus for being incorporated into composite material, i.e. in this second preferred embodiment of diameter about 25 mm) coaxial with the outer surface of the pressure plunger 7 and opening both to its top surface and to its bottom surface. A cylindrical first knock out pin 8 is adapted to be slidingly inserted into the cylindrical upper or casting chamber 3 from the top downwards and also slides tightly therein in a gas tight manner. No particular construction is provided on this first knock out pin 8 for engaging with the reinforcing material formed body 2, in this second preferred embodiment, for a reason which will be explained shortly.

This casting device 1 was used as follows, in order to practice the second preferred embodiment of the method for manufacturing composite material according to the present invention.

First, a hollow cylindrical reinforcing material formed body 2, similar to the one shown in FIG. 3 although in fact the central hole 10 was omitted, was made of boron fibers of average fiber diameter 140 microns manufactured by AVCO. This reinforcing material formed body 2 had a length of 75 mm and an external diameter of 23 mm. The formed body 2 was manufactured by aligning the boron fibers in parallel and securing the bundle near each of its ends with stainless steel wire.

Next this formed body 2 was heated to a temperature of about 750° C. in argon gas, again as a form of preheating of the type discussed above in the part of this specification entitled "BACKGROUND OF THE INVENTION". Then, with the plunger 7 withdrawn from the casting device 1 of FIGS. 4 and 5 so that the top opening of the pressure chamber 4 of the casting mold 5 thereof was open, so as to have access to the underside of said plunger 7, and with the first knock out pin 8 in an upper position in the casting chamber 3 thereof as shown in FIG. 4 with the its lower end 9 removed by about 75 mm from the bottom surface of the pressure plunger 7, one end of the reinforcing material formed body 2 was wedged into the lower open end of the casting chamber 3, into which it fitted snugly but not extremely tightly (vide the respective dimensions thereof as given above), so as to hold the thus preheated reinforcing material formed body 2 securely projecting from the underside surface of the pressure plunger 7.

Next, a quantity 6 of molten matrix metal, which in this second preferred embodiment of the present invention was aluminum alloy of JIS standard ADC12 at about 750° C., was poured into the pressure chamber 4, and then, immediately after this pouring in of the molten matrix metal 6, the pressure plunger 7 was slidingly inserted into the top of the pressure chamber 4 from above, so as to press on the free surface of the molten aluminum alloy mass 6, with the reinforcing material formed body 2 still protruding from the bottom surface of said pressure plunger 7 and still in the heated condition, so that said formed body 2 was received in the molten matrix metal 6 in the pressure chamber 4 without the sides of said formed reinforcing material body 2 coming near the sides of said pressure chamber 4. Thereby, the formed body 2 of reinforcing material was effectively kept from being cooled by the casting mold 5, by being kept clear of the sides of the mold, without the use of any particular support structure therefor. This is the state of the apparatus as shown in FIG. 4.

From this state, while still the aluminum alloy matrix metal mass 6 was completely molten, the plunger 7 was progressively pressed downwards so as to increase the pressure on the molten aluminum alloy mass 6 in the pressure chamber 4. Thus the molten aluminum alloy mass 6 started to be forced by this increasing pressure into the interstices of the reinforcing material formed mass 2, so as to become intimately intermingled with the boron fibers thereof.

When the pressure in the pressure chamber 4 reached some particular pressure, the magnitude of which is not particularly known and not particularly relevant, then this increasing pressure pushed on the lower end of the formed body and forced it upwards into the casting chamber 3 until it abutted against the end of the first knock out pin 8, so as substantially to fill said casting chamber 3, along with the molten aluminum alloy matrix metal which was already somewhat entrained into the interstices of the reinforcing material formed body 2; and the lower end of said reinforcing material formed body 2 came to be substantially flush with the upper surface of the pressure plunger 7.

Next, the pressure provided in the pressure chamber 4 by the force applied to the plunger 7 was gradually increased, according to the force applied to the top end of the plunger 7 by a means not shown in the figures and not further discussed herein, until it reached a value of approximately 1500 kg/cm$^2$. This pressurized state was maintained while the aluminum alloy matrix metal mass 6 cooled, until it had completely solidified.

Then the plunger 7 was removed from the top of the apparatus and the solidified cast form produced was removed from the apparatus, by the first knock out pin 8 being pushed downwards and the second knock out pin 12 being pushed upwards in the figures. This cast form in fact again in this second preferred embodiment consisted, as will be easily understood based upon the foregoing descriptions, of a larger cylinder made of solidified aluminum alloy only, which had been formed by solidification of aluminum alloy in the pressure chamber 4, and a smaller cylinder coaxially abutted thereto made substantially completely of reinforcing boron fiber material infiltrated with aluminum alloy matrix metal to form a composite material cylinder, which had been formed by solidification of aluminum alloy in the interstices of the boron fiber reinforcing material shaped body 2 in the casting chamber 3.

Finally, this smaller composite material cylinder was cut away from the larger aluminum alloy cylinder abutted thereto. This separation again was accomplished by a single simple saw cut, which is a very important feature of the present invention. The larger aluminum alloy cylinder was again of course recycled, while the composite material cylinder, which was the finished product, was cut in cross section and examined under an electron microscope. The results of this observation again were that no casting flaws at all were observed, such as for example penetration faults where the aluminum alloy matrix metal might not have penetrated into the boron fiber reinforcing material body sufficiently, even at the surface of the composite material body. Thus, in the same way as in the first preferred embodiment described above, it was confirmed that the aluminum alloy matrix metal had satisfactorily and evenly penetrated into the reinforcing material formed body, between the boron fibers of which it was composed, across the entire cross section of the composite material.

Substantially the same general advantages are obtained in the case of this second preferred embodiment of the present invention as in the case of the first preferred embodiment described above. In addition, according to this second preferred embodiment, the effect of the previously identified Japanese patent application Ser. No. Sho 56-32289 may be obtained, since the pressurized matrix metal 6 will tend to percolate through the interstices of the reinforcing material formed body 2, which is intercepting communication between the pressure chamber 4 and the casting chamber 3, under the influence of the difference in pressure between these two chambers, before the reinforcing material formed body 2 has been forced completely into said casting chamber 3. Thereby, the advantages of using a case with one end only open, and an air chamber defined therein, as described previously, are attained, and the molten matrix metal 6 is infiltrated into the interstices of the reinforcing material formed body 2 in a directed manner. This is done without the need arising for the removal of any case such as was used in the above identified prior art from around the produced composite material, after solidification of the matrix metal, which is accordingly very advantageous.

THE THIRD PREFERRED EMBODIMENT

Figure 6:
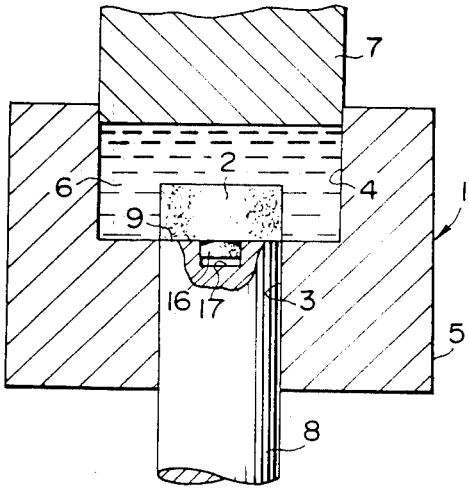
FIG. 6 is an explanatory longitudinal sectional view, similar to FIGS. 1 and 4, of a third preferred embodiment of the apparatus for producing composite material according to the present invention, shown in an earlier stage of practicing a third preferred embodiment of the method for manufacturing composite material according to the present invention in which a cylindrical reinforcing material mass is located within an upper pressure chamber thereof and is held therein by a projection on said reinforcing material mass, said third preferred apparatus embodiment providing a lower casting chamber below said upper pressure chamber thereof.
Figure 7:
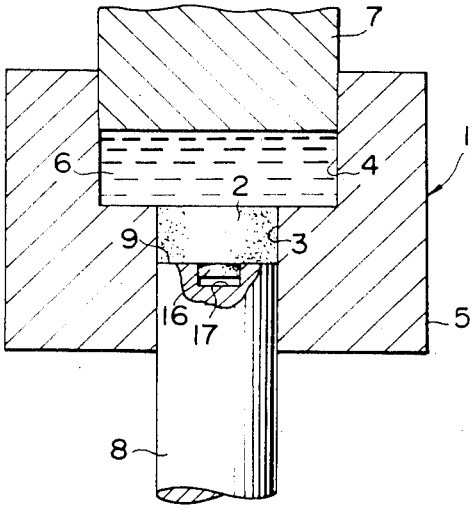
FIG. 7 is an explanatory longitudinal sectional view, similar to FIGS. 2 and 5, of said third preferred embodiment of the apparatus according to the present invention, shown in an later stage of practicing said third preferred embodiment of the method according to the present invention, in which said reinforcing material mass is located within said lower casting chamber thereof.

FIGS. 6 and 7 show, in a fashion similar to FIGS. 1 and 4 and 2 and 5 respectively, in explanatory longitudinal sectional views, an apparatus or casting device 1 which is a third preferred embodiment of the apparatus for manufacturing composite material of the present invention, again in two different phases of performance of manufacture of composite material according to a third preferred embodiment of the method for manufacturing composite material according to the present invention. In these figures, parts of the third preferred apparatus embodiment shown, which correspond to parts of the first and second preferred apparatus embodiments shown in FIGS. 1 and 2 and 4 and 5 respectively, and which have the same functions, are designated by the same reference numerals as in those figures. In this third preferred embodiment, the form of the reinforced material shaped mass 2 is different from that in the first and second preferred embodiments, and is illustrated in FIG. 8 in perspective view.

First to describe the structure of the casting device 1: as shown in FIGS. 6 and 7, this third preferred embodiment of the apparatus according to the present invention is substantially the same as the first preferred apparatus embodiment illustrated in FIGS. 1 and 2, except for the points that (1) the lower or casting chamber 3 is of a larger diameter than in the first preferred apparatus embodiment, this diameter in fact being about 40 mm, and again in fact being approximately the same as the diameter of the formed body 2 of reinforcing material that is anticipated to be used with this apparatus for being incorporated into composite material and (2) that, in this particular third preferred apparatus embodiment, the top end surface 9 of the knock out pin 8 is formed with a central depression 17 for a purpose which will become apparent later.

This casting device 1 was used as follows, in order to practice the third preferred embodiment of the method for manufacturing composite material according to the present invention.

Figure 8:
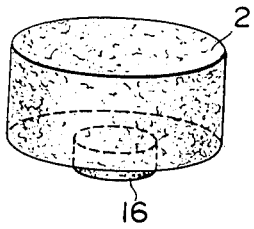
FIG. 8 is a detailed perspective view of said cylindrical formed body or mass of reinforcing material, which is being incorporated into the composite material which is being manufactured by the method which is shown as being practiced in FIGS. 6 and 7, according to said third preferred embodiment of the present invention.

First, a solid cylindrical reinforcing material formed body 2 was formed as shown in FIG. 8 of ceramic fibers of type "KAOWOOL" (this is a registered trademark) of average fiber diameter 2.8 microns, manufactured by Isolite Babcock Fireproof K. K. This ceramic reinforcing material formed cylindrical body 2 had a height of 20 mm and an approximate diameter of 39 mm, and also was formed with a central protuberance 16 of diameter approximately 15.5 mm and height approximately 5 mm, adapted to be a press fit into the depression 17 on the top end 9 of the knock out pin 8 as will be seen later. This ceramic formed body 2 was manufactured by molding the above identified ceramic fibers with substantially random orientations at a bulk density of approximately 0.18 gm/cm$^3$.

Next, this formed body 2 was heated to a temperature of 700° C. in argon gas, as a form of preheating of the type discussed above in the part of this specification entitled "BACKGROUND OF THE INVENTION". Then, with the plunger 7 withdrawn from the casting device 1 of FIGS. 6 and 7 so that the top opening of the pressure chamber 4 of the casting mold 5 thereof was open, and with the knock out pin 8 in the position in the casting chamber 3 thereof as shown in FIG. 6 with the periphery of its top end 9 flush with the bottom surface of the pressure chamber 4, the reinforcing material formed body 2 was moved into this pressure chamber 4, and the protuberance 16 on its end was press fitted snugly and tightly into the depression 17 in said top end 9 of the knock out pin 8, so as to hold the thus preheated reinforcing material formed body 2 securely within said pressure chamber 4 without the sides of said formed body 2 coming near the sides of said pressure chamber 4. Thereby, the formed body 2 of ceramic reinforcing material was effectively kept from being cooled by the casting mold 5, by being kept clear of the sides of the mold, without the use of any particular support structure therefor.

Immediately after this insertion of the reinforcing material formed body 2 into the pressure chamber 4, while said formed body 2 was still in the preheated condition, a quantity 6 of molten matrix metal, which in this third preferred embodiment of the present invention was aluminum alloy of JIS standard AC8A at about 750° C., was poured into the pressure chamber 4 so as to surround the formed body 2 therein, and then the plunger 7 was slidingly inserted into the top of the pressure chamber 4 from above, so as to press on the free surface of the molten aluminum alloy mass 6. This is the state of the apparatus as shown in FIG. 6.

From this state, while still the aluminum alloy matrix metal mass 6 was completely molten, the plunger 7 was progressively pressed downwards so as to increase the pressure on the molten aluminum alloy mass 6 in the pressure chamber 4. Thus the molten aluminum alloy mass 6 started to be forced by this increasing pressure into the interstices of the ceramic reinforcing material formed mass 2, so as to become intimately intermingled with the ceramic fibers thereof.

When the pressure in the pressure chamber 4 reached about 200 kg/cm$^2$ to 400 kg/cm$^2$, then the knock out pin 8 was lowered by an external positioning means, not shown, from its position as seen in FIG. 6 to its lower position as seen in FIG. 7, in which its upper end 9 was about 20 mm below the bottom surface of the pressure chamber 4. Thus, the lower or casting chamber 3 was opened out to be about 20 mm long, i.e. to be substantially of the dimensions of the reinforcing material formed body 2, both radially and axially. At this time, because the depression 17 in the middle of this upper end 9 of the knock out pin 8 was securely engaged with the projection 16 of the reinforcing material formed body 2, therefore this formed body 2 was carried downwards into the casting chamber 3 on the end of the knock out pin 8, so as substantially to fill it, along with the molten aluminum alloy matrix metal which was already somewhat entrained into the interstices between its ceramic fibers; and the upper end of said reinforcing material formed body 2 came to be substantially flush with the bottom surface of the pressure chamber 4.

Next, the pressure provided in the pressure chamber 4 by the force applied to the plunger 7 was gradually increased, according to the force applied to the top end of the plunger 7 by a means not shown in the figures and not further discussed herein, until it reached a value of approximately 1500 kg/cm$^2$. This pressurized state was maintained while the aluminum alloy matrix metal mass 6 cooled, until it has completely solidified.

Then the plunger 7 was removed from the top of the apparatus, and the solidified cast form produced was removed from the apparatus by the knock out pin 8 being pushed upwards in the figures. This cast form in fact consisted, as will be easily understood based upon the foregoing descriptions, of a larger cylinder made of solidified aluminum alloy only, which had been formed by solidification of aluminum alloy in the pressure chamber 4, and a smaller cylinder coaxially abutted thereto made substantially completely of reinforcing ceramic fiber material infiltrated with aluminum alloy matrix metal to form a composite material cylinder, which had been formed by solidification of aluminum alloy in the interstices of the ceramic fiber reinforcing material shaped body 2 in the casting chamber 3.

Finally, this smaller composite material cylinder was cut away from the larger aluminum alloy cylinder abutted thereto. This separation was again accomplished by a single simple saw cut, which is a very important feature of the present invention. The larger aluminum alloy cylinder was again of course recycled, while the composite material cylinder, which was the finished product, was cut in cross section and examined under an electron microscope. The results of this observation again were that no casting flaws at all were observed, such as for example penetration faults where the aluminum alloy matrix metal might not have penetrated into the ceramic fiber reinforcing material body sufficiently, even at the surface of the composite material body. Thus, similarly to the results of the first and second preferred embodiments, it was confirmed that the aluminum alloy matrix metal had satisfactorily and evenly penetrated into the ceramic reinforcing material formed body, between the ceramic fibers of which it was composed, across the entire cross section of the composite material, in this third preferred embodiment.

This third preferred embodiment is very similar to the first preferred embodiment, and accordingly detailed discussion of its advantages will be omitted herein. The variation in the means for fixing the reinforcing material formed body 2 to the upper end 9 of the knock out pin 8 may be helpful, depending upon the particular circumstances.

OTHER EXPERIMENTS

Other experiments, which will not be described in detail herein, were carried out, using magnesium alloy, copper alloy, and so forth as matrix metal, and manufacturing composite materials in analogous ways to the three preferred embodiments of the method according to the present invention which have been described above; and again, similarly to the testing procedure in the three preferred embodiments already described, sections of the resulting composite materials were examined under an electron microscope. The results of these observations again were that no casting flaws at all were observed, such as for example penetration faults where the matrix metal might not have penetrated into the reinforcing material bodies sufficiently, even at the surface of the composite material bodies. Thus, similarly to the results of the first, second, and third preferred embodiments, it was confirmed that the matrix metal had in each case satisfactorily and evenly penetrated into the reinforcing material formed bodies, between the finely divided members of which they were composed, across the entire cross section of the composite material.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

What is claimed is:

1. A method of manufacturing a composite material from a formed mass of reinforcing material and matrix metal, wherein in order:

(a) said formed mass of reinforcing material is introduced into a pressure chamber and is held therein;

(b) molten matrix metal is introduced into said pressure chamber so as to surround said formed mass of reinforcing material being held therein;

(c) said formed mass of reinforcing material, while still being surrounded in said pressure chamber by said molten matrix metal, is moved from said pressure chamber into a casting chamber of substantially smaller volume than said pressure chamber; and (d) while pressure is being applied, said molten matrix metal is allowed to solidify.

2. A method of manufacturing a composite material according to claim 1, wherein before step (a) said formed mass of reinforcing material is preheated to at least the melting point of said matrix metal.

3. A method of manufacturing a composite material according to either one of claim 1 and claim 2, wherein during steps (a) and (b) said formed mass of reinforcing material does not substantially approach the sides of said pressure chamber.

4. A method of manufacturing a composite material according to either one of claim 1 and claim 2, wherein said formed mass of reinforcing material, after being moved into said casting chamber, fits closely inside said casting chamber.

5. A method of manufacturing a composite material according to claim 3, wherein said formed mass of reinforcing material, after being moved into said casting chamber, fits closely inside said casting chamber.

6. A method of manufacturing a composite material according to claim 1, wherein said moving of said formed mass of reinforcing material from said pressure chamber into said casting chamber is performed mechanically.

7. A method of manufacturing a composite material according to claim 1, wherein said moving of said formed mass of reinforcing material from said pressure chamber into said casting chamber is performed by the force of said pressure applied upon said molten matrix metal in said pressure chamber.

8. A method of manufacturing a composite material according to claim 1, wherein said casting chamber is initially present and is substantially empty, before said molten matrix metal is introduced into said pressure chamber so as to surround said formed mass of reinforcing material being held therein.

9. A method of manufacturing a composite material according to claim 8, wherein, before said molten matrix metal is introduced into said pressure chamber so as to surround said formed mass of reinforcing material being held therein, said formed mass of reinforcing material substantially intercepts communication between said pressure chamber and said casting chamber.

10. A method of manufacturing a composite material according to claim 9, wherein said moving of said formed mass of reinforcing material from said pressure chamber into said casting chamber is performed by the force of said pressure applied upon said molten matrix metal in said pressure chamber which is not balanced by a comparable pressure in said casting chamber.

11. A method of manufacturing a composite material according to claim 1, wherein said casting chamber is not initially present before said molten matrix metal is introduced into said pressure chamber so as to surround said formed mass of reinforcing material being held therein, but is opened up by the retreat of a member defining a part of the surface of said pressure chamber, as said formed mass of reinforcing material is moved from said pressure chamber into said casting chamber.

12. A method of manufacturing a composite material according to claim 11, wherein said formed mass of reinforcing material is moved from said pressure chamber into said casting chamber, as said casting chamber opens up, by being attached to said member defining a part of the surface of said pressure chamber and being pulled thereby as it retreats.

13. An apparatus for manufacturing a composite material from a formed mass of reinforcing material and matrix metal comprising:

(a) a pressure chamber;

(b) a casting chamber communicating to and of substantially smaller volume than said pressure chamber;

(c) a means for introducing molten matrix metal into said pressure chamber;

(d) a means for holding said formed mass of reinforcing material in said pressure chamber while said molten matrix metal is introduced into said pressure chamber;

(e) a means for moving said formed mass of reinforcing material from said pressure chamber into said casting chamber while said formed mass of reinforcing material is surrounded by said molten matrix metal in said pressure chamber;

(f) a means for applying pressure to said molten matrix metal in said pressure chamber; and (g) a piston which movably engages into said casting chamber so as to vary the volume of said casting chamber.

14. An apparatus for manufacturing a composite material according to claim 13, wherein a part of said pressure chamber is defined by a cylindrical wall, and said pressure applying means is a second piston which slidably engages into said cylindrical wall.

15. An apparatus for manufacturing a composite material according to claim 14, wherein said casting member is formed in said second piston.

16. An apparatus for manufacturing a composite material according to claim 13, wherein said piston is so constructed as also to operate as a knock out pin which pushes the composite material solidified in said casting chamber out of said casting chamber.

17. An apparatus for manufacturing a composite material according to claim 13, wherein said formed mass holding means and said formed mass moving means are provided by said piston.

18. An apparatus for manufacturing a composite material according to claim 13, wherein said formed mass holding means is provided by an end portion of said casting chamber at which said casting chamber opens to said pressure chamber.

19. An apparatus for manufacturing a composite material from a formed mass of reinforcing material and matrix metal comprising:

(a) a means for forming a pressure chamber;

(b) a means for forming a casting chamber communicating to and of substantially smaller volume than the pressure chamber;

(c) a means for introducing molten matrix metal into the pressure chamber;

(d) a formed mass of reinforcing material of substantially the same size and shape as the casting chamber and situated in said pressure chamber above said casting chamber;

(e) a means for holding said formed mass of reinforcing material in said pressure chamber while said molten matrix metal is introduced into said pressure chamber;

(f) a means for moving said formed mass of reinforcing material from said pressure chamber into said casting chamber while said formed mass of reinforcing material is surrounded by said molten matrix metal in said pressure chamber;

(g) a means for applying pressure to said molten matrix metal in said pressure chamber and (h) a piston which movably engages into said casting chamber so as to vary the volume of said casting chamber.

20. An apparatus for manufacturing a composite material according to claim 19, wherein a part of said pressure chamber is defined by a cylindrical wall, and said pressure applying means is a second piston which slidably engages into said cylindrical wall.

21. An apparatus for manufacturing a composite material according to claim 20, wherein said casting chamber is formed in said second piston.

* * * * *